United States Patent [19]

Ra

[11] Patent Number: 4,481,560

[45] Date of Patent: Nov. 6, 1984

[54] SAFETY LAMP WITH NOCTILUCENT LENS HOLDER

[75] Inventor: Chang H. Ra, Bucheon-si, Rep. of Korea

[73] Assignee: Nambang Corporation, Seoul, Rep. of Korea

[21] Appl. No.: 402,892

[22] Filed: Jul. 29, 1982

[51] Int. Cl.[3] ..... F21V 9/16

[52] U.S. Cl. ..... 362/84; 362/106; 362/186; 362/190; 362/260; 362/310; 362/351; 362/362; 362/375

[58] Field of Search ..... 362/84, 106, 186, 190, 362/260, 310, 351, 362, 375

[56] References Cited

U.S. PATENT DOCUMENTS

| | | | |
|---|---|---|---|
| 1,866,157 | 7/1932 | Ford | 362/84 |
| 3,449,558 | 6/1969 | Whitmer | 362/84 |
| 4,092,704 | 5/1978 | Malm | 362/106 |
| 4,120,023 | 10/1978 | McReynolds | 362/16 |

*Primary Examiner*—Stephen J. Lechert, Jr.

*Attorney, Agent, or Firm*—Birch, Stewart, Kolasch & Birch

[57] ABSTRACT

A lamp, particularly a miner's safety lamp, is provided with a noctilucent lens holder so that in the event of an accident causing non functioning of the normal light source of the lamp, the lens holder will provide luminous light.

1 Claim, 2 Drawing Figures

SAFETY LAMP WITH NOCTILUCENT LENS HOLDER

BACKGROUND OF THE INVENTION

This invention relates to lamps and is particularly applicable to safety lamps which are used by miners attached to their helmets.

Usually, when a miner's lamp is turned off because of a pit accident, it is very hard to find his position because of the darkness inside the mining pit. If there is a glimmer light by the miner, it is easier to find the position of the victim of a pit accident.

It is known for miners to have luminous paint painted on the surface of their helmets in order to assist in finding the worker when the worker's lamp is turned off by a pit accident. However, such luminous paint painted on the surface of a helmet wears off during the passage of time. Also, because the light from the lamp is directed forwardly, little light is received by the helmet or the luminous paint thereon and the luminous quality quickly loses any power.

SUMMARY OF THE INVENTION

An object of this invention is to provide an efficient luminous source suitable for use by miners or others. Therefore, the invention provides a lamp provided with a part, preferably the lens holder, which is normally illuminated by the light source, which is made of luminous material, preferably luminous resin.

Since the lens holder will normally be illuminated by the lamp bulb and the luminous material will not be abraded away like paint, the luminous source will retain its presence and strength to be always available when needed.

BRIEF DESCRIPTION OF THE DRAWINGS

One embodiment of the invention will now be described by way of example only with reference to the accompanying drawings of which.

DETAILED DESCRIPTION OF A PREFERRED EMBODIMENT

Figure 1:
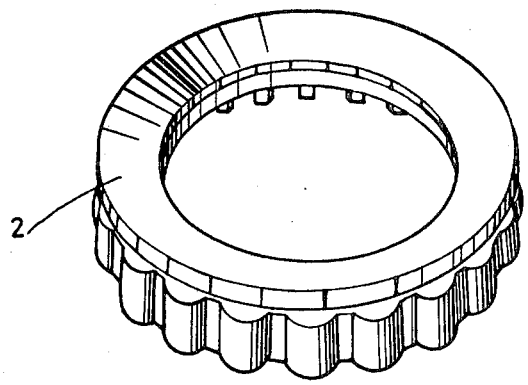
FIG. 1 is the perspective of a lens holder of a lamp in accordance with the invention.
Figure 2:
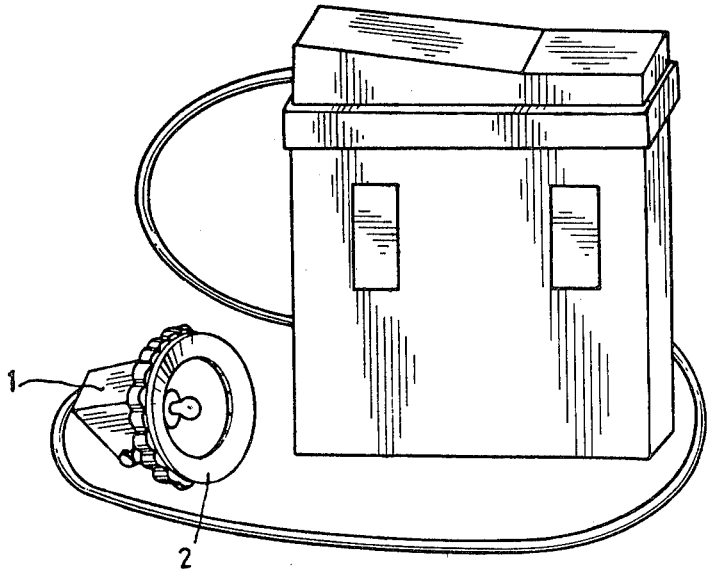
FIG. 2 is a perspective view of the lens holder attached to a lamp and battery.

A lens holder 2 of a safety lamp 1 is composed of 80% to 90% of Acrylonitrile Butadiene Styrene resin and 10% to 20% of luminous material (powder of paint) such as ZnS-Cu and CaS-Bi so that the lens holder is noctilucent.

The lens holder, composed of the luminous resin, will keep receiving light from the lamp bulb as long as the lamp is turned on.

In the case of a pit accident, with the lamp going off the lens holder will instantly give a noctiluent light. Since the lens holder 2 receives light whenever the lamp is turned on, the luminous property of the noctiluent material of which the lens holder is made is semi-permanent. The noctiluent lens holder will give enough light so that either the worker will be able to find the way by himself in case of lamp failure, or the researches of the rescue team will be facilitated by the emission of the noctilucent light.

I claim:

1. A light fixture comprising:

a housing;

a reflector operatively mounted within said housing;

a light source operatively positioned relative to said reflector for projecting light outwardly from said a lens holder operatively attached to said housing for retaining said reflector and light source;

said lens holder being constructed of a luminous material for receiving light during normal operation and for continuing to radiate light after the light source is extinguished;

said luminous material being composed of 80% to 90% of Acrylonitrile Butadiene Styrene resin and 10% to 20% luminous paint powder wherein the luminous paint powder is selected from the group consisting of ZnS-Cu and CaS-Bi.

* * * * *